US011399238B2

(12) United States Patent
Watson et al.

(10) Patent No.: US 11,399,238 B2
(45) Date of Patent: Jul. 26, 2022

(54) MICROPHONE DEVICE WITH INDUCTIVE FILTERING

(71) Applicant: Knowles Electronics, LLC, Itasca, IL (US)

(72) Inventors: Joshua Watson, Wheaton, IL (US); Karan Jumani, Schaumburg, IL (US); Donald Yochem, Buffalo Grove, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 17/156,494

(22) Filed: Jan. 22, 2021

(65) Prior Publication Data

US 2021/0144487 A1 May 13, 2021

Related U.S. Application Data

(63) Continuation of application No. PCT/US2019/042675, filed on Jul. 19, 2019.

(60) Provisional application No. 62/702,317, filed on Jul. 23, 2018.

(51) Int. Cl.

| | |
|---|---|
| ***H04R 3/00*** | (2006.01) |
| ***H04R 19/04*** | (2006.01) |
| ***H01F 27/40*** | (2006.01) |
| ***H04R 1/04*** | (2006.01) |
| ***H04R 31/00*** | (2006.01) |

(52) U.S. Cl.

CPC ..... *H04R 19/04* (2013.01); *H01F 27/40* (2013.01); *H04R 1/04* (2013.01); *H04R 3/00* (2013.01); *H04R 31/006* (2013.01); *H04R 2201/003* (2013.01); *H04R 2410/03* (2013.01)

(58) Field of Classification Search

CPC . H04R 19/04; H04R 1/04; H04R 3/00; H04R 31/006; H04R 2201/003; H04R 2410/03; H01F 27/40

USPC ..... 381/113, 111

See application file for complete search history.

(56) References Cited

U.S. PATENT DOCUMENTS

| | | | | |
|---|---|---|---|---|
| 9,485,560 | B2 | 11/2016 | Vos | |
| 2010/0213601 | A1* | 8/2010 | Smeys | H01L 24/24 257/698 |
| 2014/0167900 | A1* | 6/2014 | Murtagian | H01F 27/2852 336/192 |
| 2015/0189446 | A1 | 7/2015 | Wang | |
| 2015/0251898 | A1* | 9/2015 | Vos | B81C 1/0023 257/416 |

(Continued)

OTHER PUBLICATIONS

Rogala, Tomasz, International Search Report, International Application No. PCT/US2019/042675, European Patent Office, Rijswijk, NL, dated Oct. 10, 2019.

*Primary Examiner* — Ammar T Hamid

(74) *Attorney, Agent, or Firm* — Loppnow & Chapa; Matthew C. Loppnow

(57) ABSTRACT

Microphone devices and methods for manufacturing microphone devices that include a substrate having a first surface and a second surface, a cover secured to the first surface of the substrate to form an enclosed back volume, an application specific integrated circuit (ASIC) embedded between the first surface and the second surface of the substrate, a microelectromechanical systems (MEMS) transducer mounted on the first surface of the substrate, and an inductor mounted on the first surface of the substrate.

22 Claims, 5 Drawing Sheets

(56) References Cited

U.S. PATENT DOCUMENTS

| | | | | |
|---|---|---|---|---|
| 2015/0285874 | A1* | 10/2015 | Taylor | G01R 33/07 324/251 |
| 2018/0279057 | A1* | 9/2018 | Khenkin | B81B 7/0064 |
| 2020/0091608 | A1* | 3/2020 | Alpman | H01Q 1/38 |

* cited by examiner

MICROPHONE DEVICE WITH INDUCTIVE FILTERING

CROSS-REFERENCE TO RELATED PATENT APPLICATION

This application claims the benefit of U.S. Provisional Patent Application No. 62/702,317, filed Jul. 23, 2018, the disclosure of which is incorporated herein by reference in its entirety.

BACKGROUND

Microphones are deployed in various types of devices such as personal computers, cellular phones, mobile devices, headsets, headphones, and hearing aid devices. The microphones are often used proximate to other components that can send and receive acoustic signals. Accordingly, the microphones can include filter components for preventing the acoustic signals from other components from causing noise in the microphone signal.

Figure 1:
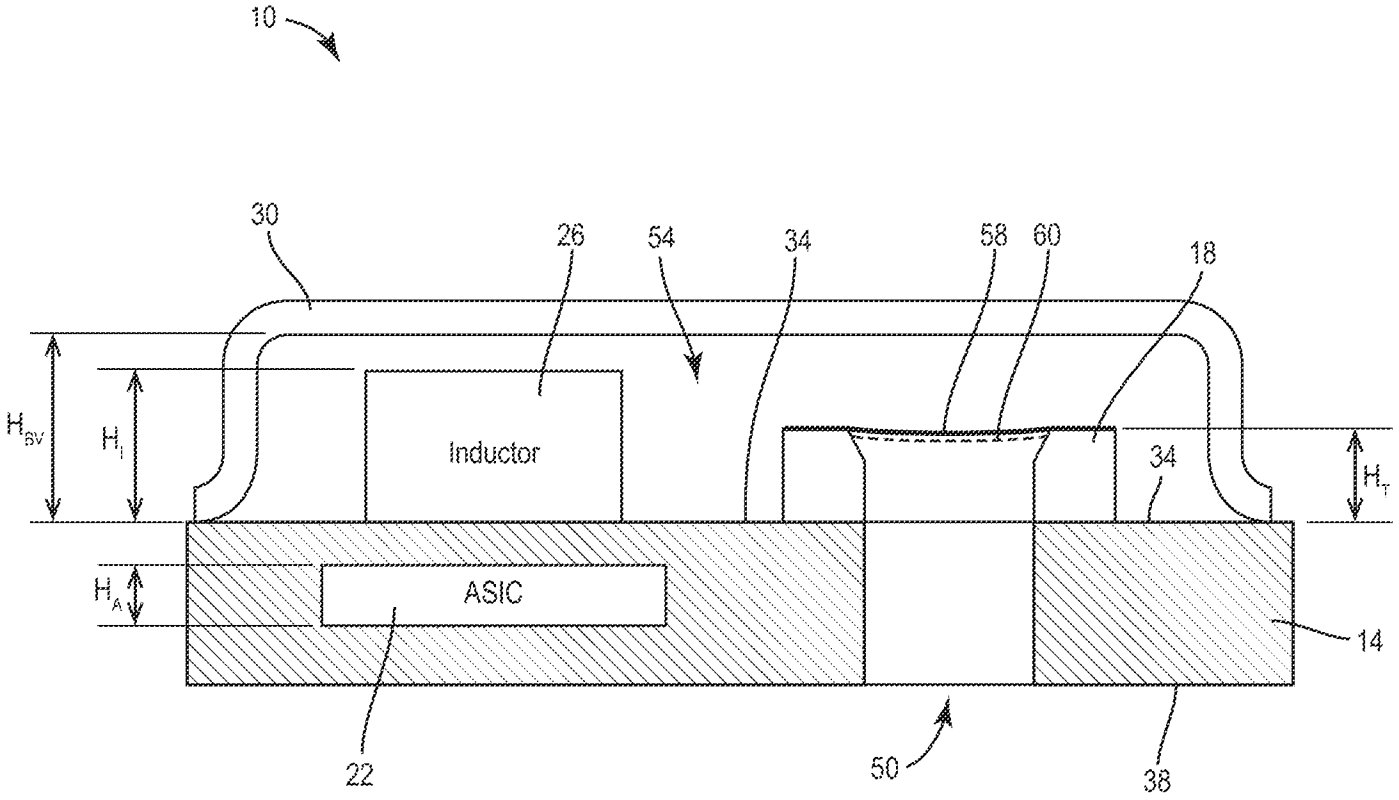
FIG. 1 is a cross-sectional view of a microphone device according to some implementations of the present disclosure.

In the following detailed description, reference is made to the accompanying drawings, which form a part hereof. In the drawings, similar symbols typically identify similar components, unless context dictates otherwise. The illustrative implementations described in the detailed description, drawings, and claims are not meant to be limiting. Other implementations may be utilized, and other drawings may be made, without departing from the sprit or scope of the subject matter presented here. It will be readily understood that aspects of the present disclosure, as generally described herein, and illustrated in the figures can be arranged, substituted, combined, and designed in a wide variety of different configurations, all of which are explicitly contemplated and make part of this disclosure.

DETAILED DESCRIPTION

The present disclosure describes devices and techniques for a microphone device that includes an inductive radio frequency (RF) filter. More specifically, one or more inductors used to form an inductive RF filter are positioned within a back volume of the microphone device. The microphone device includes an application specific integrated circuit (ASIC) that is embedded within a substrate of the microphone device such that the inductors can be positioned in the back volume, such as in a portion of the back volume of the microphone device that is traditionally occupied by the ASIC, without requiring changes in the dimensions of the back volume.

The inductive RF filters used in the microphone device of the present disclosure improve the performance of the microphone device relative to microphone devices that include resistive-capacitive (RC) or capacitive RF filters. For example, the resistors utilized in RC filters can reduce a voltage delivered to a digital microphone device, thus reducing the drive capacity of the microphone device. Furthermore, resistors and/or capacitors used in RC or capacitive filters can filter out a portion of an acoustic signal sent using digital communication protocols, such as pulse density modulation (PDM) and SoundWire protocols. Inductive filters pass acoustic signals sent according to PDM and/or SoundWire protocols, while filtering out undesirable RF signals.

FIG. 1 illustrates a cross-sectional view of a microphone device 10 according to an exemplary implementation of the present disclosure. The microphone device 10 includes a substrate 14, a microelectromechanical (MEMS) transducer 18, an application specific integrated circuit (ASIC) 22, one or more inductors 26, and a cover 30. In FIG. 1, the inductor(s) 26 is illustrated schematically. The substrate 14 includes a front (first) surface 34 and a back (second) surface 38. The MEMS transducer 18 is mounted to the front surface 34 of the substrate 14. The ASIC 22 is embedded within the substrate 14 such that the ASIC 22 is positioned between the front surface 34 and the back surface 38 of the substrate 14. The inductor(s) 26 is mounted to the front surface 34 of the substrate 14 generally above the ASIC 22. The MEMS transducer 18, the ASIC 22, and the substrate 14 can include conductive bonding pads to which wires can be bonded. In some implementations, the wires can be bonded to the appropriate bonding pads using a solder. For example, a first set of wires electrically connect the MEMS transducer 18 to the ASIC 22, while a second set of wires electrically connect the ASIC 22 to conducive traces (not shown) on substrate 14, in some implementations. Additional wires electrically connect the plurality of inductors 26 to the ASIC 22 as discussed in greater detail below.

The substrate 14 can include, without limitation, a printed circuit board, a semiconductor substrate, or a combination thereof. A portion of the substrate 14 adjacent the MEMS transducer 18 defines a through-hole that forms a sound port 50 of the microphone device 10. Acoustic signals enter the microphone device 10 through the sound port 50 and cause displacement of a portion of the MEMS transducer 18. The MEMS transducer 18, based on its response to the displacement, can generate electrical signals corresponding to the incident audio.

The cover 30 can be mounted on the substrate 14 to form an enclosed volume (back volume) 54 between the cover 30 and the front surface 34 of the substrate 14. The cover 30 encloses and protects the MEMS transducer 18, the ASIC 22, and wires forming electrical connections therebetween, such as the first wires and the second wires. The cover 30 can include materials such as plastic or metal. The cover 30, the substrate 14, the MEMS transducer 18, and the ASIC 22 define the enclosed back volume 54, dimensions of which can be factored into selecting performance parameters of the MEMS transducer 18. In some implementations, the cover 30 is affixed to the substrate 14 and, in some implementations, the back volume 54 is hermetically sealed.

The MEMS transducer 18 can include a conductive diaphragm 58 spaced apart from a conductive back plate 60. The diaphragm 58 is configured to move relative to the back plate 60 in response to incident acoustic signals. The movement of the diaphragm 58 in relation to the back plate 60 causes a capacitance of the MEMS transducer 18 between the diaphragm 58 and the back plate 60 to vary. The change in capacitance of the MEMS transducer 18 in response to the acoustic signals can be measured and converted into a corresponding electrical signal. Accordingly, the spatial relationship between the MEMS transducer 18 and the cover 30 can be sized for specific microphone performance parameters (i.e., microphone performance may be modified by increasing or decreasing a size of one or both of the back volume 54 and the diaphragm 58). In various implementations, the MEMS transducer 18 can include multiple diaphragms and/or backplates.

Figure 2:
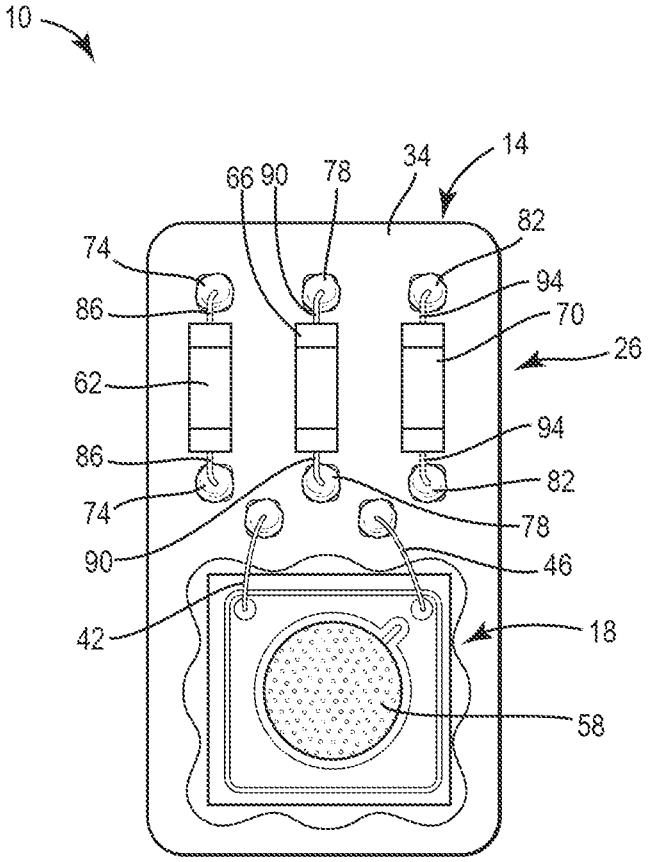
FIG. 2 is a top view of a substrate of the microphone device of FIG. 1 according to some implementations of the present disclosure.

The ASIC 22 can include a package that encloses analog and/or digital circuitry for processing electrical signals received from the MEMS transducer 18. In one or more implementations, the ASIC 22 can be an integrated circuit package having a plurality of pins or bonding pads that facilitate electrical connectivity to components outside of the ASIC 22 via wires. Referring to FIG. 2, the ASIC 22 can include bonding pads (not shown) to which the first set of wires 42, the second set of wires 46, and additional wires can be connected. The analog or digital circuitry can include amplifiers, filters, analog-to-digital converts, digital signal processors, polyfuses, and other electrical circuitry for processing the electrical signal received from the MEMS transducer 18 and other components on the substrate 14. Polyfuses are memory components that can be programmed to store information such as calibration data, chip identification numbers, and/or memory repair data. Polyfuses can be programmed (e.g., trimmed) by applying high currents (e.g., trimming currents). In other implementations, the ASIC 22 can include EEPROM and/or flash memory. The use of inductive filters in microphone devices 10 that include EEPROM and/or flash memory increases an impedance on the line including the inductor that is higher than a resistance generated by a resistor in a RC filter. Accordingly, the use of inductive filters is advantageous over using a RC filter.

Referring back to FIG. 1, in some implementations, the ASIC 22 is embedded within the substrate 14 such that the ASIC 22 is positioned between the front surface 34 and the back surface 38 of the substrate 14. Embedding the ASIC 22 within the substrate 14 can facilitate the dissipation of heat generated by operation of the ASIC 22. In some implementations, embedding the ASIC 22 fills the space in which RC filter components (e.g., resistors and capacitors) could otherwise be embedded in the microphone device 10. Embedding the ASIC 22 within the substrate 14 provides additional space within the back volume 54 of the microphone device 10 without changing the dimensions of the back volume 54 of the microphone device 10. As shown in FIG. 1, embedding the ASIC 22 within the substrate 14 provides additional space within the back volume 54 of the microphone device 10 for receiving the plurality of inductors 26.

The inductor(s) 26 is secured to the front surface 34 of the substrate 14 generally above the embedded ASIC 22. The inductor(s) 26 is positioned in the space typically occupied by the ASIC in prior art microphone devices in which the ASIC is secured to the front surface of substrate. As is shown schematically in FIG. 1, a height $H_I$ of the inductor(s) 26 is higher than a height $H_T$ of the MEMS transducer 18, but lower than a height $H_{BV}$ of the back volume 54. For example, in the illustrated implementation, the height $H_{BV}$ of the back volume 54 is approximately 457 μm, the height $H_I$ is approximately 300 μm, and the height $H_T$ is approximately 200 μm. Embedding the ASIC 22 in the substrate 14 provides sufficient space for the inductor(s) 26 without changing the dimensions of the back volume 54 of the microphone device 10. As indicated in FIG. 1, a height HA of the ASIC 22 is approximately 100 μm. A combined height of the ASIC 22 and the inductor(s) 26 is therefore larger than the height $H_{BV}$ of the back volume 54. Accordingly, embedding the ASIC 22 allows the inductor(s) 26 to be positioned within the back volume 54. Expanding the back volume 54 to receive the inductor(s) 26 mounted on the ASIC 22 without embedding the ASIC 22 could cause the height of the cover 30 and/or microphone device 10 to be undesirably tall. The inductor(s) 26 can be ceramic chip inductors, ferrite bead inductors, or silicon chip-based inductors. In the illustrated implementation, the inductor(s) 26 are SMT 01005 chip inductors. In other implementations of microphone devices having differently shaped back volumes, SMT 0201 chip inductors or SMT 0402 chip inductors can be used. The SMT 01005 chip inductors, SMT 0201 chip inductors, and/or SMT 0402 chip inductors can be ceramic chip inductors or ferrite bead inductors. In such implementations, the chip inductors can be selected based on the dimensions of the back volume such that the inductors fit within the back volume of the microphone device. In implementations that include silicon chip-based inductors, the silicon chip-based inductors can be custom-sized to fit within the back volume of the microphone device.

FIG. 2 illustrates a top view of the substrate 14 of the microphone device 10 with the cover 30 removed. In the illustrated implementation, the inductor(s) 26 includes a first inductor 62, a second inductor 66, and a third inductor 70. The inductors 62, 66, 70 are mounted above the ASIC. In some implementations, the inductors 62, 66, 70 can be the same size. In other implementations, the inductors 62, 66, 70 can be different sizes. For example, larger inductors may be used on the microphone power (e.g., VDD) line and smaller inductors can be used on the digital clock and/or digital output lines. In other implementations, the microphone device 10 may include more or fewer inductors. The front surface 34 of the substrate 14 completely covers the ASIC. As indicated in FIG. 2, the first set of wires 42 and the second set of wires 46 have an end that is connected to the MEMS transducer 18 and an end that extends beneath the front surface 34 of the substrate 14 to reach the ASIC. A first pair of pads 74 is adjacent the first inductor 62, a second pair of pads 78 is adjacent the second inductor 66, and a third pair of pads 82 is adjacent the third inductor 70. A third pair of wires 86 extends between the first inductor 62 and the ASIC. A fourth pair of wires 90 extends between the second inductor 66 and the ASIC. A fifth pair of wires 94 extends between the third inductor 70 and the ASIC.

Figure 3:
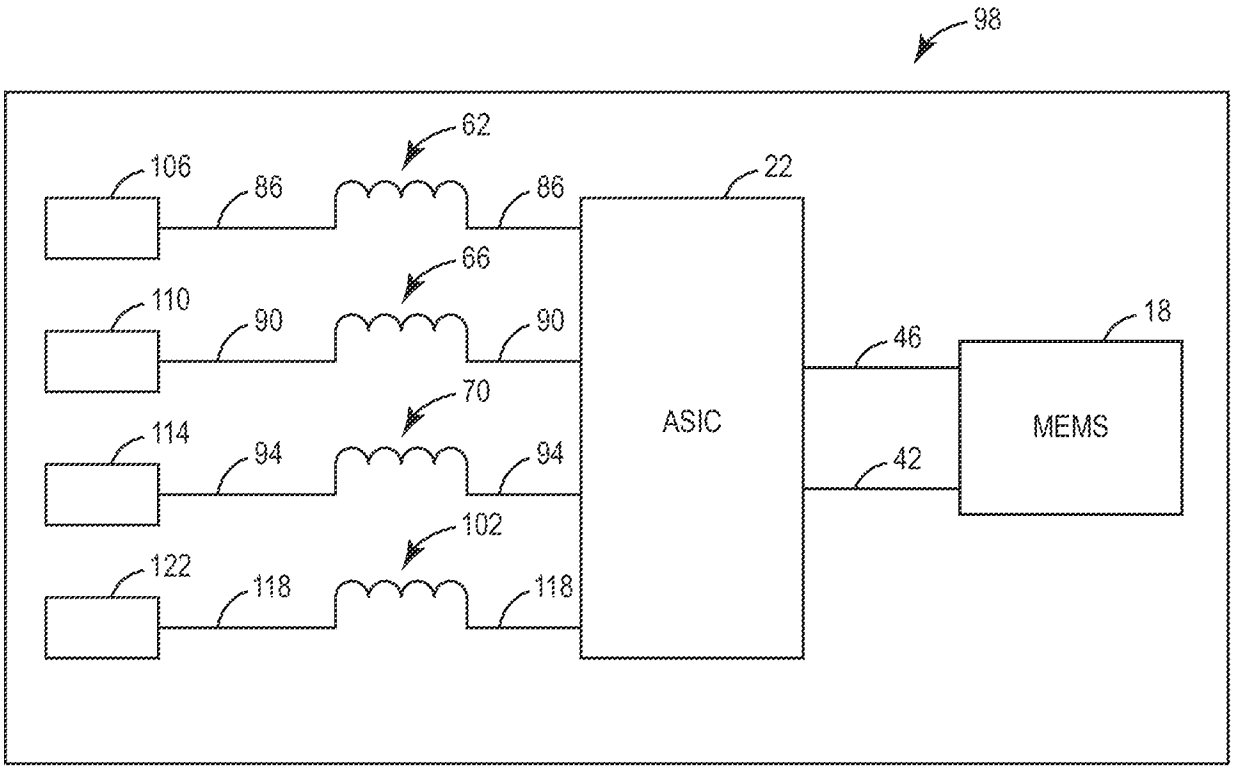
FIG. 3 is a schematic representation illustrating connections between an application specific integrated circuit (ASIC) and an inductor on the substrate of FIG. 2 according to some implementations of the present disclosure.

FIG. 3 illustrates a schematic representation of the electrical connections to and from the ASIC 22 for a microphone device 98 according to another implementation of the present disclosure in which the plurality of inductors 26 includes a fourth inductor 102. The implementation illustrated in FIG. 3 is substantially similar to the implementation illustrated in FIG. 2. Accordingly, like parts are illustrated using like numbers. The ASIC 22 of the microphone device 10 can have similar electrical connections to those shown in FIG. 3. The ASIC 22 is connected to the MEMS transducer 18 by the first wire 42 and the second wire 46. The third pair of wires 86 extends between a first pad 106 and the ASIC 22. The first inductor 62 is positioned along the third pair of wires 86 to act as a filter and prevent radiofrequency (RF) signals from traveling to the ASIC 22 along the third pair of wires 86. The fourth pair of wires 90 extends between a second pad 110 and the ASIC 22. The second inductor 66 is positioned along the fourth pair of wires 90 to act as a filter and prevent RF signals from traveling to the ASIC 22 along the fourth pair of wires 90. The fifth pair of wires 94 extends between a third pad 114 and the ASIC 22. The third inductor 70 is positioned along the fifth pair of wires 94 to act as filter and prevent RF signals from traveling to the ASIC 22 along the fifth pair of wires 94. A sixth pair of wires 118 extends between a fourth pad 122 and the ASIC 22. The fourth inductor 102 is positioned along the sixth pair of wires 118 to act as a filter and prevent RF signals from traveling to the ASIC 22 along the sixth pair of wires 118. The first pad 106, the second pad 110, the third pad 114, and the fourth pad 122 can be positioned on the back surface of the substrate (not shown).

In implementations including ceramic chip inductors and/or ferrite inductors, any of the inductors 62, 66, 70, 102 can be coated with an epoxy layer to prevent the coated inductors 62, 66, 70, 102 from vibrating.

In implementations in which the microphone device 98 is a digital microphone, one of the pairs of wires 86, 90, 94, 118 can be a microphone power (e.g., VDD) line, one of the pairs of wires 86, 90, 94, 118 can be a clock input line, and one of the pairs of wires 86, 90, 94, 118 can be a digital output line. In implementations in which the microphone device 98 is an analog microphone, one of the pairs of wires 86, 90, 94, 118 can be a VDD line and at least one of the pairs of wires 86, 90, 94, 118 can be an output line. In some implementations in which the microphone device 98 is an analog microphone, one of the pairs of wires 86, 90, 94, 118 can be a digital interface line. In some implementations, the digital interface line can be connected to a digital output pin of the ASIC 22, such as an inter-integrated circuit (I2C) pin.

In some implementations, the microphone device 98 can have more or fewer inductors based on the type of microphone, the size of the microphone, and/or the number of input and/or outputs to the ASIC 22. For example, analog microphones can have two inductors, with one of the inductors positioned on the VDD line and one of the inductors positioned on the microphone output line. Trimmable analog microphones can have three inductors, with one of the inductors positioned on the VDD line, one of the inductors positioned on the output line, and one of the inductors positioned on the trim lime. Digital or differential microphones can have four or more inductors, with one of the inductors positioned on the VDD line, one of the inductors positioned on the output line, one of the inductors positioned on a digital clock input line, and one of the inductors positioned on the digital output line.

In implementations where the microphone device 98 may be positioned proximate other devices that send and/or receive acoustic signals, this can result in noisy ground conditions. For example, noisy ground conditions can occur when the microphone device 98 is positioned at a bottom of a phone near an antenna of the phone. The radiofrequency (RF) energy from the antenna is coupled onto the ground plane that is also coupled to the microphone device 98. The RF energy of the antenna can conduct back into the microphone device 98 along the ground plane, causing noise in the microphone device 98 (e.g., "noisy ground"). Under noisy ground conditions, communication signals from a nearby antenna can cause RF signals to radiate along wires connected between the ASIC 22 and pads on the substrate 14, such as the third pair of wires 86, the fourth pair of wires 90, the fifth pair of wires 94, and the sixth pair of wires 118. Accordingly, in the illustrated implementation, the first inductor 62, the second inductor 66, the third inductor 70, and the fourth inductor 102 are positioned along the third pair of wires 86, the fourth pair of wires 90, the fifth pair of wires 94, and the sixth pair of wires 118, respectively, to act as RF filters. In the illustrated implementation, the inductor (s) 26 improves the performance of the ASIC 22 by 10-15 decibels (dB) relative to unfiltered configurations of the ASIC 22. The implementation illustrated in FIG. 3 is a non-limiting, exemplary configuration of the connections to and from the ASIC 22. Other implementations may include different configurations of the connections to and from the ASIC 22.

Figure 4:
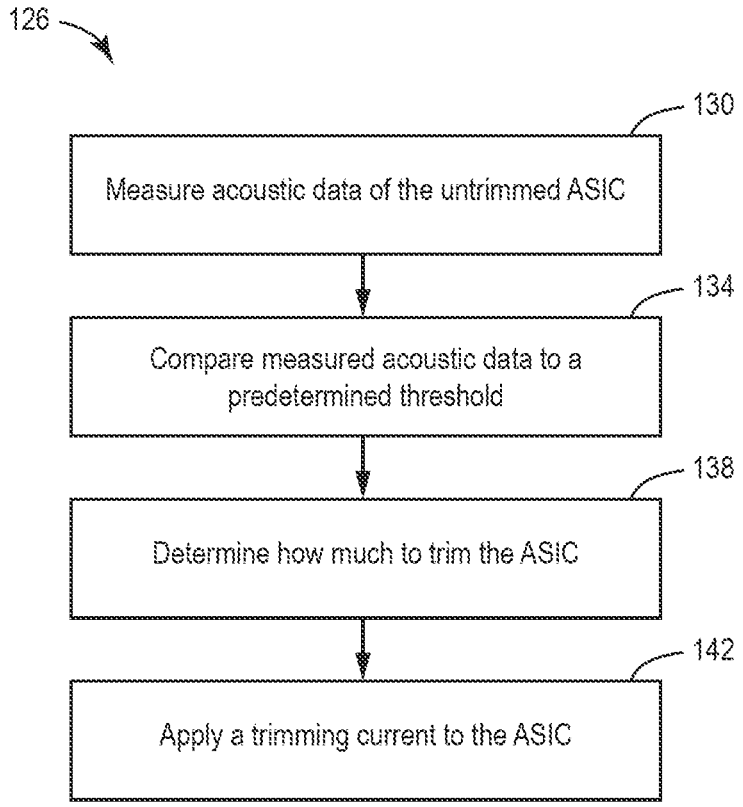
FIG. 4 is a flowchart illustrating a process for trimming an ASIC of the microphone device of FIG. 1 according to some implementations of the present disclosure.

In some implementations, the ASIC 22 can be calibrated by trimming one or more trimmable components within the ASIC 22. In some implementations, the trimmable components are polyfuses. FIG. 4 illustrates a flowchart of a process 126 for trimming the ASIC 22 according to an exemplary implementation. A first step in the trimming process 126 is to measure acoustic data of the untrimmed ASIC 22 (130). The measured acoustic data is compared to a predetermined threshold (134). A next step is to determine how much to trim at least one polyfuse of the ASIC 22 based on a difference between the measured acoustic data and the predetermined threshold (138). The difference between the measured acoustic data and the predetermined threshold can be indicative of a sensitivity in the ASIC 22. A trimming current (e.g., current spike) is then applied to one or more of the pads 106, 110, 114, 122 to trim one or more polyfuses in the ASIC 22 (142). The wire (e.g., between the pad 106, 110, 114, 122 and the ASIC 22) forms a conductive path between the current source, the ASIC 22, and the polyfuse(s) that are being trimmed. In some implementations, the trimming current can be up to 100 mA.

In implementations in which RC filters are used, a resistor of the RC circuit is positioned on the wire between a location at which the trimming current is provided and the ASIC. Accordingly, the resistor prevents the trimming current from reaching the ASIC, so voltages high enough to burn the polyfuse cannot be generated with the ASIC in such implementations including RC filters. In contrast, the microphone device 10 according to the present disclosure can include an inductor(s) 26 positioned on the wire (e.g., along the conductive path) connected to the ASIC 22 and the polyfuse(s). The inductor 26 allows the trimming current to pass to the ASIC 22 without being filtered. Accordingly, polyfuses within the ASIC 22 and connected to wires (conductive paths) that include any of the plurality of inductors 26 can be trimmed.

In other implementations, the trimmable components can include ASICs, digital signal processors (DSPs), temperature sensors, and/or other types of sensors embedded in the microphone or integrated into a single chip.

Figure 5:
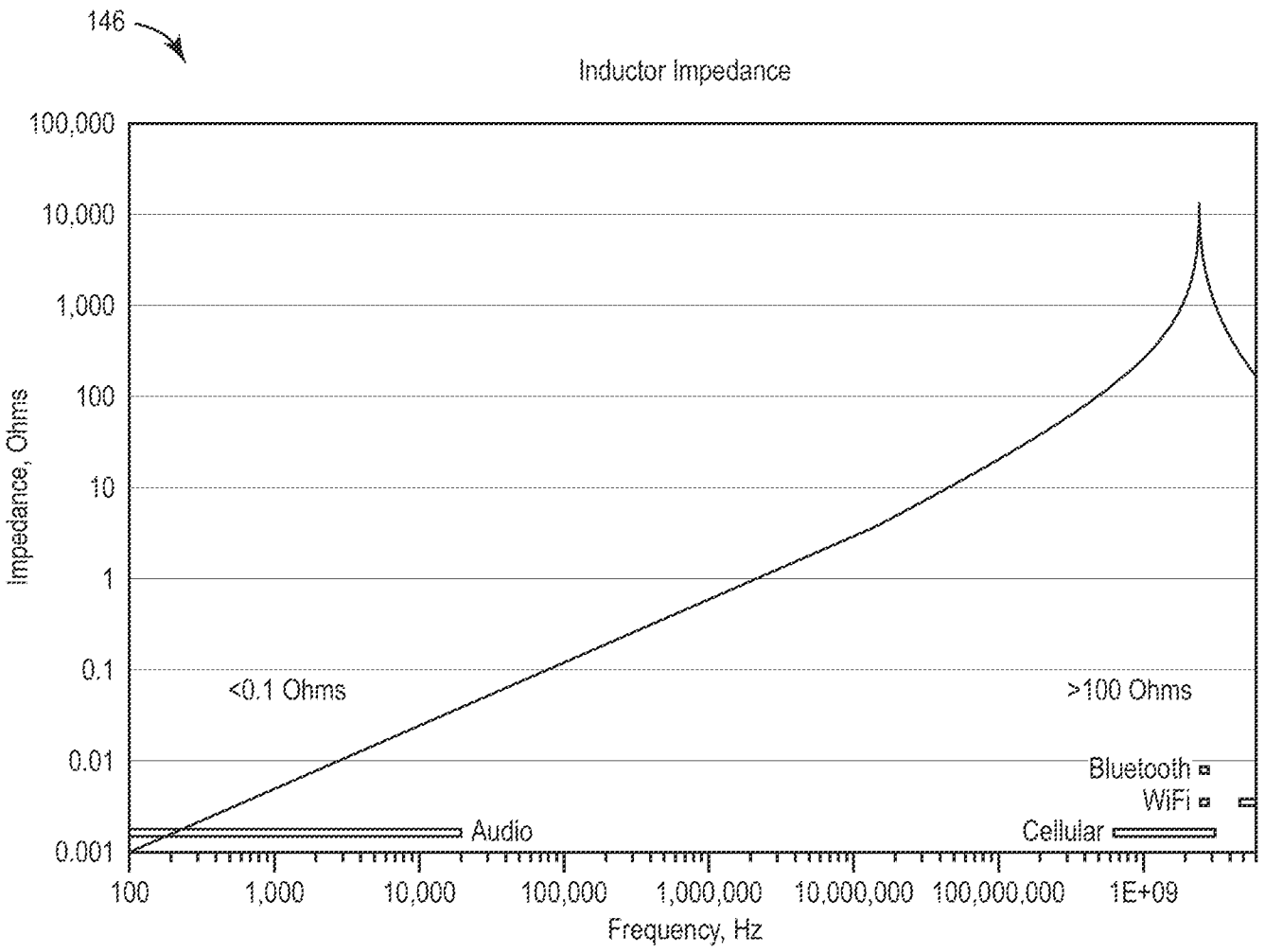
FIG. 5 is a plot illustrating inductor impedance versus signal frequency.

FIG. 5 illustrates a plot 146 of the impedance v.s. frequency for the plurality of inductors 26. As shown in the plot 146, the inductor(s) 26 has an impedance that increases as a signal frequency increases until approximately 2.5 GHz and then decreases. An audio frequency range is between approximately 20 Hz-20 KHz. As illustrated in the plot 146, the inductor(s) 26 has a very low resistance (e.g., less than 0.1Ω) in the acoustic frequency range. Accordingly, the inductor(s) 26 allow substantially all of the signals in the acoustic frequency range to pass to the ASIC 22. Radiofrequency (RF) signals are often sent and received proximate the microphone device 10. Such RF signals are often antenna communication signals, such as Bluetooth signals, WiFi signals, and cellular signals. The Bluetooth frequency band is approximately 2.4 GHz-2.5 GHz and is indicated on the plot 146. As indicated in the plot 146, the impedance in the Bluetooth range is higher than the acoustic frequency range. For example, as indicated in the plot 146, the impedance in the Bluetooth range is between approximately 1000Ω-approximately 10,000Ω, which is several orders of magnitude higher than the resistance in the acoustic range. The cellular (e.g., 2G, 3G, 4G, and/or 5G) frequency band ranges between approximately 600 MHz-3 GHz. As indicated in the plot 146, the inductor(s) 26 has an impedance ranging from approximately 100Ω-approximately 10,000Ω. Accordingly, substantially all signals in the cellular frequency range are prevented from reaching the ASIC 22. The WiFi frequency bands are indicated in FIG. 5 and are approximately 2.4 GHz, 3.6 GHz, 4.9 GHz, 5 GHz, and 5.9 GHz. The plurality of inductors 26 has an impedance of at least approximately 100Ω-approximately 1500Ω in the WiFi frequency range. Accordingly, substantially all signals in the WiFi frequency range are prevented from reaching the ASIC 22. In summary, FIG. 5 indicates that the inductor(s) 26 has an impedance of less than 0.1Ω in the audio frequency range and the inductor(s) has an impedance of greater than 100Ω for RF signals. Accordingly, the inductor(s) 26 effectively filter the RF signals while allowing audio frequency signals to pass.

In the illustrated implementations, the plurality of inductors 26 replaces RC filters or capacitive (C) filters that are used in some microphone devices. The use of the inductor(s) 26 as inductive filter(s) as described in the present disclosure improves the microphone device 10 with respect to the existing microphone devices. For example, the microphone device 10 can be configured to operate according to a pulse density modulation (PDM) protocol. The PDM protocol includes a digital clock input and digital data output. Positioning a RC filter or a C filter on a line having a digital clock input, a digital data output, or a microphone power line can reduce performance of the microphone device. For example, positioning a resistor on the clock digital input line and/or on the digital output line can cause the resistor to round the digital signal, which can damage and/or remove at least part of the microphone signal. Positioning a resistor on the microphone power line can reduce a voltage supplied to the microphone device, which can reduce a drive capability of the microphone device. Similarly, with respect to both RC filters and capacitive filters, capacitors large enough to be effective RF filters are large enough to filter the digital clock input and/or the digital data output signals used in the PDM protocol, which can damage and/or remove at least part of the microphone signal. Inductors, however, do not round the digital clock input or the digital data output signals. Furthermore, inductors do not reduce an amount of voltage supplied to the microphone device 10. Accordingly, using the plurality of inductors 26 as inductive filters improves both the quality of the microphone signal and the performance of the microphone device 10 as compared to prior art microphone devices that include capacitive filters and/or RC filters.

In some implementations, the microphone device 10 can be configured to operate according to the SoundWire protocol. The SoundWire protocol includes a digital microphone input and a digital microphone output. Again, positioning a RC filter or a capacitive filter on a line having a digital input, a digital output, or a microphone power line can reduce performance of the microphone device 10. The frequency of signals sent according to the SoundWire protocol can have frequencies as high as tens of MHz. Resistors and/or capacitors large enough to filter out RF signals also filter out Soundwire signals sent at such frequencies, which can damage and/or remove at least part of the microphone signal. Furthermore, positioning a resistor on the microphone power line can reduce a voltage supplied to the microphone device, which can reduce a drive capability of the microphone device. The plurality of inductors 26, however, will pass signals in the tens of MHz range, as indicated above in FIG. 5. Inductive filters, therefore, improve the performance of the microphone device 10 relative to prior art microphones that include RC filters and/or capacitive filters when operating according to the SoundWire protocol.

One implementation relates to a microphone device including a substrate having a first surface and a second surface, a cover secured to the first surface of the substrate to form an enclosed back volume, an application specific integrated circuit (ASIC) embedded between the first surface and the second surface of the substrate, a microelectromechanical systems (MEMS) transducer mounted on the first surface of the substrate, and an inductor mounted on the first surface of the substrate.

Another implementation relates to a method of manufacturing a microphone device. The method includes embedding an application specific integrated circuit (ASIC) into a substrate of the microphone device. The ASIC includes a trimmable component. The substrate includes a first surface and a second surface and the ASIC is embedded between the first surface and the second surface. The method further includes mounting an inductor on the first surface of the substrate, electrically coupling the ASIC and the inductor, which is positioned along a conductive path, and applying a trimming current to the conductive path to trim the trimmable component. The trimming current passes through the inductor before the trimming current enters ASIC and trims the trimmable component.

The herein described subject matter sometimes illustrates different components contained within, or connected with, different other components. It is to be understood that such depicted architectures are illustrative, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including by not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one recitation, even when the same claim includes the introductory phrases "one or more" or "at least one" and indefinite articles such as "a" or "an" (e.g. "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two functions," without other modifiers, typically means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g. "a system having at least one of A, B, or C: would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Further, unless otherwise noted, the use of the words "approximate," "about," "around," "substantially," etc., means plus or minus ten percent.

The foregoing description of illustrative elements has been presented for purposes of illustration and of description. It is not intended to be exhaustive or limiting with respect to the precise form disclosed, and modifications and variations are possible in light of the above teachings or may be acquired from practice of the disclosed implementations. It is intended that the scope of the invention be defined by the claims appended hereto and their equivalents.

What is claimed is:

1. A microphone device comprising: a substrate having a first surface and a second surface; a cover secured to the first surface of the substrate to form an enclosed back volume; an application specific integrated circuit (ASIC) embedded between the first surface and the second surface of the substrate; a microelectromechanical systems (MEMS) transducer mounted on the first surface of the substrate; and an inductor mounted on the first surface of the substrate.

2. The microphone device of claim 1, wherein the inductor is configured to filter radio frequency (RF) signals from reaching the ASIC.

3. The microphone device of claim 2, wherein the microphone device is a digital microphone, and wherein the inductor is positioned along a microphone device power line, a clock input line, or an output line.

4. A microphone device comprising: a substrate having a first surface and a second surface; a cover secured to the first surface of the substrate to form an enclosed back volume; an application specific integrated circuit (ASIC) embedded between the first surface and the second surface of the substrate; a microelectromechanical systems (MEMS) transducer mounted on the first surface of the substrate; and an inductor mounted on the first surface of the substrate, wherein the inductor is configured to filter radio frequency (RF) signals from reaching the ASIC, wherein the microphone device is a digital microphone, and wherein the inductor is positioned along a microphone device power line, a clock input line, or an output line, and wherein the inductor is a first inductor and the microphone device further comprises a second inductor positioned along another of the microphone device power line, the clock input line, or the output line.

5. The microphone device of claim 4, wherein the second inductor is smaller than the first inductor, and wherein the first inductor is positioned along the microphone device power line and the second inductor is positioned along the clock input line or the output line.

6. The microphone device of claim 2, wherein microphone device is an analog microphone, and wherein the inductor is positioned along a microphone device power line or an output line.

7. A computer device comprising a substrate having a first surface and a second surface; a cover secured to the first surface of the substrate to form an enclosed back volume; an application specific integrated circuit (ASIC) embedded between the first surface and the second surface of the substrate; a microelectromechanical systems (MEMS) transducer mounted on the first surface of the substrate; and an inductor mounted on the first surface of the substrate, wherein the inductor is configured to filter radio frequency (RF) signals from reaching the ASIC, wherein microphone device is an analog microphone, and wherein the inductor is positioned along a microphone device power line or an output line, and wherein the inductor is a first inductor and further comprising a second inductor positioned along the other of the microphone device power line or the output line.

8. The microphone device of claim 1, wherein the inductor is a first inductor and further comprising a second inductor smaller than the first inductor, and wherein the first inductor is positioned along a microphone device power line and the second inductor is positioned along an output line.

9. The microphone device of claim 7, wherein the ASIC is embedded below the inductor.

10. The microphone device of claim 7, wherein an epoxy layer is formed on the inductor.

11. The microphone device of claim 7, wherein the inductor is a 01005 chip inductor, a 0201 chip inductor, or a 0402 chip inductor.

12. The microphone device of claim 7, wherein the inductor is a ceramic chip inductor, a ferrite bead inductor, or a silicon chip-based inductor.

13. The microphone device of claim 1, wherein the ASIC includes a polyfuse and wherein the inductor is positioned along a conductive path to the polyfuse and configured such that a trimming current pass through the inductor before the trimming current enters the ASIC and trims the polyfuse.

14. A method of manufacturing a microphone device, the method comprising: embedding an application specific integrated circuit (ASIC) into a substrate of the microphone device, the ASIC including a trimmable component, the substrate comprising a first surface and a second surface and the ASIC embedded between the first surface and the second surface; mounting an inductor on the first surface of the substrate; electrically coupling the ASIC and the inductor, the inductor positioned along a conductive path; and applying a trimming current to the conductive path to trim the trimmable component, the trimming current passing through the inductor before the trimming current enters ASIC and trims the trimmable component.

15. The method of claim 14, wherein the inductor is configured to filter radio frequency (RF) signals from reaching the ASIC.

16. The method of claim 15, wherein the microphone device further comprises a cover and a microelectromechanical systems (MEMS) transducer, and wherein the cover is secured to the substrate, such that the inductor and the MEMS transducer are enclosed within a volume defined between the substrate and the cover.

17. The method of claim 16, wherein a combined height of the ASIC and the inductor is greater than a height of the enclosed back volume.

18. The method of claim 14, wherein the inductor is an 01005 chip inductor, a 0201 chip inductor, or a 0402 chip inductor.

19. The method of claim 14, wherein the trimmable component is a polyfuse, an application-specific integrated circuit, a digital signal processor, or a sensor.

20. The method of claim 14, wherein the inductor is a ceramic chip inductor, a ferrite bead inductor, or a silicon chip-based inductor.

21. The microphone device of claim 4, wherein a height of the inductor is greater than a height of the MEMS transducer.

22. The microphone device of claim 4, wherein a combined height of the ASIC and the inductor is greater than a height of the enclosed back volume.

* * * * *